US005594186A

United States Patent [19]

Krause et al.

[11] Patent Number: 5,594,186

[45] Date of Patent: Jan. 14, 1997

[54] HIGH DENSITY METAL COMPONENTS MANUFACTURED BY POWDER METALLURGY

[75] Inventors: Robert F. Krause, Valparaiso; Joseph H. Bularzik, Munster, both of Ind.; Harold R. Kokal, Glenwood, Ill.

[73] Assignee: Magnetics International, Inc., Burns Harbor, Ind.

[21] Appl. No.: 501,670

[22] Filed: Jul. 12, 1995

[51] Int. Cl.[6] ..... B22F 1/00

[52] U.S. Cl. ..... 75/228; 419/23

[58] Field of Search ..... 419/23; 75/228

[56] References Cited

U.S. PATENT DOCUMENTS

| | | | |
|---|---|---|---|
| 3,948,690 | 4/1976 | Pavlik et al. | 148/31.55 |
| 4,158,580 | 6/1979 | Reynolds et al. | 148/104 |
| 4,158,581 | 6/1979 | Krause et al. | 148/105 |
| 4,158,582 | 6/1979 | Krause | 148/120 |
| 4,265,681 | 5/1981 | Krause et al. | 148/111 |
| 5,080,712 | 1/1992 | James et al. | 75/229 |
| 5,154,881 | 10/1992 | Rutz et al. | 419/37 |
| 5,268,140 | 12/1993 | Rutz et al. | 419/54 |

OTHER PUBLICATIONS

Takeda et al., "Newly developed pulverised swarf forging," *Met. Powder Rep.*, 36(5), May, 1981, pp. 215–221.

Hausner, "Correlation between characteristics of powders and pores and their effect on the properties of P/M materials," Conference proceedings—P/M 82 in Europe, Internatonal Powder Metallurgy Conference, 1982, pp. 569–575.

Rajab et al., "Density distributions in complex shaped parts made from iron powders," *Powder Mettal.*, 28(4), 1985, pp. 207–216.

Braddick, "The manufacture of sintered stainless steel components for structural engineering applications," *Stainless Steel Ind.*, 15(85), May, 1987, pp. 8–10.

Krause, "AC magnetic characteristics of cores made from pressed, annealed, and repressed rectangular steel particles," *J. Appl. Phys.*, 57(1), Apr. 15, 1985, pp. 4255–4257.

Klar, "Stainless steel powders at SCM metal products," *Met. Powder Rep.*, 43(3), Mar., 1988, pp. 160–165.

Suzuki et al., "Development of As–sintered P/M connecting rods for automobiles," *Int. J. Powder Metall.*, 24(3), Jul., 1988, pp. 243–250.

Sanderow, "High temperature sintering of ferrous P/M components," *New Perspectives in Powder Metallurgy*, vol. 8, 1990, pp. 15–34.

Suh et al., "A study of compressibility, green and sintered strength of iron powders," Conference Proceedings—Advances in Powder Metallurgy, vol. 5, 1991. pp. 151–160.

*Primary Examiner*—Charles T. Jordan
*Assistant Examiner*—Anthony R. Chi
*Attorney, Agent, or Firm*—Marshall, O'Toole, Gerstein, Murray & Borun

[57] ABSTRACT

A high density metal component manufactured by powder metallurgy is disclosed. The powder metallurgy method provides metal components having a density greater than 95% of theoretical density using a single sequence of uniaxial pressing and heating. The metal components are manufactured from substantially linear, acicular metal particles having a substantially triangular cross section.

30 Claims, 2 Drawing Sheets

HIGH DENSITY METAL COMPONENTS MANUFACTURED BY POWDER METALLURGY

FIELD OF THE INVENTION

The present invention relates to high density metal components manufactured by powder metallurgy. More particularly, the present invention relates to metal components having a density at least 95% of theoretical density, and formed by powder metallurgy from substantially linear, acicular metal particles having a substantially triangular cross section.

BACKGROUND OF THE INVENTION

The manufacture of metal components using a metal powder as the raw material, i.e., powder metallurgy, has been used for decades. Powder metallurgy is an excellent method of shaping metals into a predetermined design because of an efficient use of energy and materials. Powder metallurgy provides metal components of near net shape, and therefore is a common method of manufacturing large volumes of close tolerance metal components.

The manufacture of a metal component by powder metallurgy includes four basic steps to convert a metal powder into a metal component. Each step is controlled such that the finished metal component conforms to design specifications both within a single production batch and also between production batches.

The first step is preparation of a metal powder mixture. The metal powder mixture typically includes: (1) the metal powder being used as the material of construction, and (2) a lubricant. The metal powder can be a single metal species or can be a combination of different types of metal species. The metal powder particles typically are spherical in shape. The lubricant is added to minimize friction between the metal power and the tooling during a compaction, or pressing, step. The lubricant is present in an amount of up to about 2% by weight of the metal powder mixture.

After forming the metal powder mixture, the mixture is pressed in a die of predetermined shape. During the pressing operation, the spherical metal powder particles deform and interlock to form a compressed article, termed a "green compact," having a die fill ratio of about 2.3 to 1, or about 40% the original height of the metal powder height. As used here and hereafter, the term "die fill ratio" is defined as the ratio of the uncompressed metal powder height in the die to the height of the green compact. The shape of the green compact is determined by the geometry of the die. The green compact can be handled, but is fragile.

The density of the green compact (i.e., "green density") is determined primarily by the applied pressing load. The ability of the green compact to maintain its predetermined shape without cracking, fracturing, or crumbling during handling is referred to as the "green strength" of the compact. If green strength is too low, the green compact easily crumbles or cracks when removed from the die, which makes manufacture into a methyl component difficult to impossible.

After pressing, the green compact is subjected to an elevated temperature to form a metal component. The green compact is heated at a sufficiently high temperature and for a sufficient time to decompose, or pyrolyze, the lubricant, and to increase the density and strength of the metal component.

Conventionally, the green compact is heated in steps, initially to a first temperature to pyrolyze the lubricant, then to a second higher temperature to increase the density and strengthen the metal component, i.e., to sinter the metal component. A typical sintering furnace comprises a continuously running mesh belt which carries the green compacts through the furnace. Heating cycle times typically are about 1 to 3 hours, with 20 to 60 minutes at a sintering temperature in excess of 1000° C. The sintered metal component, after cooling, then is subjected to optional secondary operations, such as deburring, to provide the final finished metal component.

The strength of a metal component is directly related to the density of the metal component, which in turn is directly related to the density of the green compact. Therefore, investigators have continually searched for ways to increase the density of both the green compact and the metal component to approach 100% theoretical density. As used here and hereafter, the term "100% theoretical density" is defined as the density of the metal, metals, and/or alloys forming the metal component. "Percent (%) theoretical density" is defined as the ratio of green compact density, or metal component density, to the density of the metal, metals, and/or alloys from which the green compact or metal component is manufactured.

Metal components manufactured by the above-described traditional powder metallurgy process, and using metal powder particles having spherical or near spherical geometry, have a theoretical density of about 88% to about 92%. Metal components having a density in this range often exhibit low strength, and are susceptible to corrosion due to the porosity of the metal component. Such metal components are unsuitable for many practical applications because they are subject to failure. In some instances, these relatively low density metal components are used in high load applications but are oversized to withstand use conditions.

One method investigators found to increase the density and improve the physical properties of a metal component manufactured by powder metallurgy was to press the metal component a second time, after sintering. The repressing step is termed "sizing" or "restriking." Then, if desired, the sized metal component can be resintered. Typically, repressing and resintering provides a metal component having a density up to about 95% of theoretical density. The extra processing steps of repressing and resintering are costly and time-consuming, and only minimally improve the density and physical properties of the metal component over traditional powder metallurgy processes.

Another powder metallurgy technique used to increase the density of the metal component is "warm" pressing the mixture of metal powder and lubricant at a temperature up to about 370° C., and usually at about 150° C. to about 260° C. "Warm" pressing provides a green compact having a higher density than a green compact prepared by traditional powder metallurgy techniques which utilize "cold," or ambient temperature, pressing. Sintering a warm-pressed green compact provides a metal component having a density up to about 95% of theoretical density, and typically about 85% to about 94% of theoretical density. The method of pressing at an elevated temperature is disclosed in Rutz et al. U.S. Pat. No. 5,154,881, for example. A primary disadvantage of "warm" pressing is the increased cost of the metal component.

Other methods, such as hot isostatic pressing, also have been used to increase the density, and decrease the porosity, of metal components manufactured by powder metallurgy.

An exemplary technique is disclosed in James et al. U.S. Pat. No. 5,080,712. Each of the above-described techniques is more costly than a traditional powder metallurgy process, but provided metal components having a density no greater than about 96% of theoretical density.

Workers in the art also investigated whether the shape of the metal powders affected the density of green compacts and metal components prepared by powder metallurgy. Conventionally, metal powder particles used in powder metallurgy are spherical or near-spherical in shape.

In powder metallurgy, micron-sized, spherical metal powder particles are blended with a die lubricant and compacted into a predetermined shape. The amount of lubricant used with spherical metal powder is about 0.25% to about 2%, and typically about 0.5% to about 1%, by weight of the metal powder mixture. After pressing, a green compact containing the spherical metal powder has a green density less than 90% of theoretical density. This relatively low green density is attributed to: (1) the resistance of spherical metal powder to efficiently compress to high densities in a die, (i.e., spheres inherently resist compaction and arrays of spheres have substantial void spaces between the spheres), and (2) the relatively higher volume occupied by the low density lubricant (which decreases the overall density of the green compact). During heating and sintering, the lubricant is pyrolyzed and the density of the resulting metal component is increased, but typically to less than 93% of the theoretical density of the metal or metal alloy. The low density of the metal component adversely affects performance.

Spherical metal powder particles require relatively large amounts of lubricant because each powder particle must be coated with a minimum amount of lubricant, and spherical powder particles have a large surface area to weight ratio. However, it is desirable to minimize the amount of lubricant in the metal powder mixture in order to minimize the die volume occupied by the lubricant, and thereby increase the density of the green compact. Investigators attempting to minimize the amount of lubricant present in the metal powder mixture have addressed the morphology, i.e., the size and shape, of the metal powder particles.

With respect to size of the metal powder particles, because each metal powder particle requires a minimum thickness of lubricant coating, the present investigators theorize that reducing the surface area-to-weight ratio of the metal powder particles prior to pressing would reduce the amount of lubricant needed to coat the metal powder. The reduced amount of lubricant would result in an increased green density, and, subsequently, an increased density of the finished metal component.

Increasing the size of spherical metal powder particles reduces the surface area-to-weight ratio of metal particles. For example, an idealized 20 micron spherical iron particle has a surface area-to-weight ratio of about 400 square centimeters per gram ($cm^2/g$). Increasing the diameter of the spherical powder particle by a factor of two, or to 40 microns, reduces the surface area-to-weight ratio to about 200 $cm^2/g$, or about one-half. The larger spherical powder size can be expected to reduce the amount of lubricant required to lubricate the die. However, increasing the size of the spherical powdered metal does not appreciably increase the density of the final metal component because spherical metal powders of any size do not readily compress to provide a high density green compact or metal component.

In addition, the green strength of the green compact is reduced when larger spherical metal powders are used. Thus, preferred metal powder particles have a shape that is more easily compressed than spherical metal powders, have a low surface area-to-weight ratio, and exhibit a sufficient green strength to facilitate handling of the green compact.

Various publications have addressed the effects of powder particle size, powder particle shape, lubricant content, sintering temperature and pressing techniques on the density of a metal part manufactured by powder metallurgy. These publications include:

S. Suh et al., "A Study of Compressibility, Green and Sintered Strength of Iron Powders," Conference Proceedings, *Advances in Powder Metallurgy*-1991, *Vol.* 5, *P/M Materials,* pages 151–160 (1991);

H. H. Hausner, "Correlation Between Characteristics of Powders and Pores and Their Effect on the Properties of P/M Materials," Conference Proceedings, P/M-82 in Europe, International Powder Metallurgy Conference, pages 569–575 (1982); and H. I. Sanderow, "High Temperature Sintering of Ferrous P/M Components," *New Perspectives in Powder Metallurgy, Vol.* 9, *High Temperature Sintering,* pages 15–34 (1990).

The following patents and publication disclose the pressing of elongated rectangular-shaped particles into magnet materials. The metal particles were thin, elongated parallelopipeds having a substantially rectangular cross section and a width to height ratio of about 1.5:1 to about 4:1.

R. F. Krause, "AC Magnetic Characteristics of Cores Made from Pressed, Annealed, and Repressed Rectangular Steel Particles," *J. Appl. Phys.*, 57(1), pages 4255–4257, Apr. 15, 1985;

Pavlik et al. U.S. Pat. No. 3,948,561;

Pavlik et al. U.S. Pat. No. 4,158,561;

Reynolds et al. U.S. Pat. No. 4,158,580;

Krause et al. U.S. Pat. No. 4,158,581;

Krause et al. U.S. Pat. No. 4,158,582; and

Krause et al. U.S. Pat. No. 4,265,681.

The particle shape disclosed in the above-identified publication and patents provides green compacts having high green densities. However, these rectangular cross section particles have a poor flowability and a poor die fill ratio (i.e., about 3.5 to 1 or greater). As a result, elongated metal particles having a substantially rectangular cross section are difficult to compact during pressing.

In particular, metal particles having a poor die fill ratio of greater than 3 to 1 require deep pressing dies (i.e., have a substantial height), and poor flow characteristics. The poor flow characteristics of the particles having a substantially rectangular cross section results in long die fill times and high production costs. Also, high die abrasion (i.e., short die life) can occur when pressing metal powders having a poor die fill ratio.

SUMMARY OF THE INVENTION

The present invention is directed to a metal component prepared by conventional powder metallurgy techniques and having a density at least 95% of theoretical density. The metal component is prepared from substantially linear, acicular metal particles having a substantially triangular cross section. The powder metallurgy process preferably utilizes a single pressing step to form a green compact, and a single heating step to provide a dense metal component.

In particular, the present invention is directed to providing a metal component by powder metallurgy from a metal particle mixture comprising metal particles and about 0.015% to about 0.5% by weight of a lubricant. Each metal particle is substantially linear, acicular, and has a substantially triangular cross section. The triangular cross section of each metal particle has a height to base ratio of about 0.08:1 to about 1:1. A major proportion of the metal particles have a triangular cross section wherein the height-to-base ratio is about 0.2:1 to about 1:1. The "base" of the triangle, as used herein, is defined as the longest side of the substantially triangular cross section.

The acicular metal particles have an aspect ratio, i.e., length-to-base ratio, of at least 3 to 1. The metal particles typically are linear, although a slight curvature does not adversely affect a metal component prepared from the metal particles. As used herein, the term "at least" is defined as synonymous to "at a minimum," "or more," and "or greater."

Another important aspect of the present invention is to use a powdered metal having a sufficiently small particle size to efficiently fill the die cavity of the press, but also is of sufficient size such that the metal particles do not approach a spherical shape or behave like a spherical-shaped powder. The metal particles therefore have dimensions of about 0.002 to about 0.05 inches in height, about 0.002 to about 0.05 inches along the base, and about 0.006 to about 0.20 inches in length.

Another important aspect of the present invention is to provide metal particles having a substantially triangular cross section and a die fill ratio of less than 3 to 1, with sufficient particle flow characteristics, to permit the economical manufacture of a metal component having a green density of at least 95% of theoretical density.

Yet another aspect of the present invention is to utilize a metal particle mixture, such as a ferrous particle mixture, further comprising up to about 12% by weight, carbon, manganese, nickel, copper, molybdenum, or mixtures thereof, as a powder, to provide a metal component having optimum strength. Alternatively, the metal particles can contain up to about 12% by weight, carbon, manganese, nickel, copper, molybdenum, or mixtures thereof.

Another important aspect of the present invention is to provide a green compact that exhibits a decrease in volume of about 2% or less during the sintering step.

Another aspect of the present invention is to provide a green compact and a metal component having an improved density without the need to employ either a press-sinter-repress-anneal sequence or "warm" pressing, and therefore avoid the attendant increases in processing costs associated with these additional processing steps.

Another aspect of the present invention is to provide a method of increasing the density, and therefore the strength, of a metal component manufactured by powder metallurgy. The method comprises pressing a metal particle mixture into a green compact, heating the green compact to pyrolyze the lubricant and form a metal component, then optionally sintering the metal component to form a sintered metal component. The density of the green compact, and the metal component, is at least 95% (i.e., 95% or greater) of theoretical density because the size and shape of the metal particles permits the use of less lubricant in the metal particle mixture and provides more efficient packing and interlocking between metal particles.

BRIEF DESCRIPTION OF THE DRAWING

The above and other aspects and advantages of the present invention will become apparent from the following detailed description of the preferred embodiments taken in conjunction with the drawing, wherein.

DETAILED DESCRIPTION OF THE PREFERRED EMBODIMENTS

Figure 1:
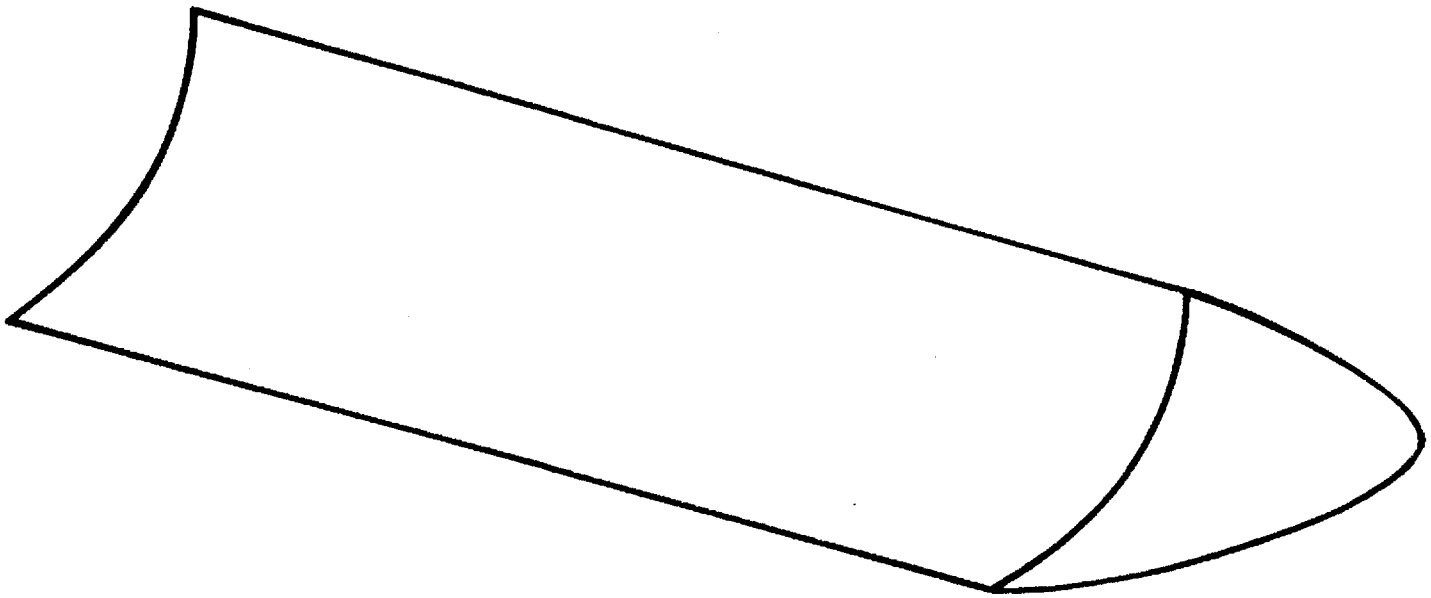
FIG. 1 is a perspective view of a metal particle used in the present method of forming a high density metal component.

A metal component of the present invention is prepared by the traditional powder metallurgy process comprising the steps of: (1) forming a metal particle mixture comprising metal particles and a lubricant, (2) cold uniaxial pressing the metal particle mixture to form a green compact having a high green density and good green strength, (3) heating the green compact at a sufficient temperature to pyrolyze the lubricant and form a metal component, (4) optionally sintering the metal component at a sufficient temperature for a sufficient time to impart additional strength to the metal component and form a sintered metal component, and (5) cooling the metal component or sintered metal component, then performing optional secondary operations on the metal component to provide a finished metal component. Preferably, the present powder metallurgy method comprises a single cold, uniaxial pressing step, a single heating step, and a single sintering step, and provides a green compact and a metal component having a density at least 95%, and typically at least 96%, of theoretical density and a finished metal component of essentially the identical size and shape of the green compact.

The metal component is manufactured by first forming a metal particle mixture. The metal particle mixture comprises: (1) metal particles, and (2) about 0.015% to about 0.5% by weight of a lubricant. Preferably no other components are present in the metal particle mixture. However, if desired, other optional components can be incorporated into the metal particle mixture to perform a predetermined function. Depending on the amount of optional components in the metal particle mixture, the optional components can decrease the density of the finished metal component.

In particular, the metal particle mixture comprises about 0.015% to about 0.5% of a lubricant. The lubricant reduces die wear and facilitates extraction of the green compact from the die after pressing. The amount of lubricant present in the metal particle mixture is maintained at a minimum because the lubricant necessarily occupies a portion of the die volume. An excess amount of lubricant can reduce the green density of the green compact.

For example, a lubricant typically is an organic compound having a density of about 0.8 to about 1 g/cc (grams per cubic centimeter). In contrast, the powdered metal typically has a density of about 6 to about 8 g/cc. Accordingly, on a volume basis, even a small amount of lubricant by weight occupies an appreciable portion of the die volume. To achieve a high density, the die volume occupied by the lubricant is minimized. Therefore, the lubricant preferably is present in an amount of about 0.015% to about 0.4%, and most preferably about 0.015% to about 0.25%, by weight of the metal particle mixture.

The lubricant is an organic compound capable of being decomposed, or pyrolyzed, at the heating temperature. The pyrolysis products are gases which are expelled from the metal component during heating. The lubricant is a solid compound at room temperature, and is incorporated into the metal particle mixture in particulate form.

The lubricant preferably pyrolyzes essentially completely during heating of the green compact. Complete pyrolysis of the organic lubricant expels the lubricant from the metal component and avoids the presence of by-products in the metal component. The exclusion of lubricant by-products provides a metal component that is purer, has a higher density, and has greater strength.

Exemplary lubricants that can be used in the powdered metal mixture include, but are not limited to, ethylene bis-stearamide, a $C_{12}$–$C_{20}$ fatty acid, like stearic acid, a paraffin, a synthetic wax, a natural wax, a polyethylene, a fatty diester, a fatty diamide, and mixtures thereof.

Salts of organic acids, like zinc, lithium, nickel, iron, copper, or magnesium stearate, also can be used as the lubricant. However, acid salt lubricants can leave a metal oxide by-product in the finished metal component. The metal oxide by-product can adversely affect the metal component.

The major component of the metal particle mixture is the metal particles. The metal particles are present in the metal particle mixture in an amount of at least 87.5% (i.e., 87.5% or more) by weight when optional components in addition to the lubricant are present in the metal particle mixture. If the metal particle mixture contains essentially only the metal particles and the lubricant, the metal particles are present in an amount of about 99.5% to about 99.985%, and preferably about 99.6% to about 99.985%, by weight of the metal particle mixture. To achieve the full advantage of the present invention, the metal particles are present in an amount of about 99.75% to about 99.985%, by weight of the metal particle mixture.

The specific identity of the metal particles in the metal particle mixture is not limited, as long as the metal particles can be manufactured into a metal component by powder metallurgy techniques. The identity of the metal particles is dependent upon the intended practical application of the metal component. The metal particles can comprise a single species of metal particles, e.g., all the particles are iron particles, or a combination of metal particle species to provide a particular alloy.

Nonlimiting examples of types of metal particles include, but are not limited to, iron, aluminum, stainless steel, copper, titanium, zinc, nickel, tin, beryllium, niobium, chromium, molybdenum, tungsten, cobalt. The metal particles also can comprise a super alloy, such as Udimet 720, IN 617, or Waspalloy. The metal particles also can comprise an alloy, such as, for example, iron alloyed with molybdenum, manganese, chromium, carbon, sulfur, silicon, copper, nickel, vanadium, niobium, gold, aluminum, phosphorus, or mixtures thereof.

In accordance with another important feature of the present invention, the metal particles, and especially ferrous particles, can contain up to about 12% by weight carbon, manganese, nickel, copper, molybdenum, and mixtures thereof. When one or more of these elements is present in the metal particle mixture in an amount up to about 12% by weight, the properties of the metal component are improved. Alternatively, one or more of these elements can be added to the metal particle mixture as a powder. To attain optimum density and properties in the metal component, the amount of carbon, manganese, nickel, copper, molybdenum, or mixtures thereof, added to the metal particle mixture as a powder in an amount of up to about 12% by weight.

An important feature of the present invention is the size and shape of the metal particles. In particular, the metal particles are sufficiently small to effectively pack together and yield a green compact of high density. However, the metal particles cannot be of such small particle size that the particles have the shape of, or behave like, spheres. Spherically shaped particles do not effectively pack together to form a dense green compact. Spherically shaped metal particles also resist compaction into a dense green compact. The metal particles useful in the present invention have a size and shape such that the surface area to weight ratio for a particular metal particle is about 20% or less, of the surface area to weight ratio of a sphere of the conventional powdered metal.

The metal particles are substantially linear, acicular particles having a substantially triangular cross section as illustrated in the embodiment depicted in FIG. 1. The metal particles can be linear, or can be slightly curved along the longitudinal axis (i.e., the length of a chord connecting the ends of a metal particle is at least 95% of the length of the metal particle), without adversely affecting a metal component prepared by powder metallurgy.

The metal particles of substantially triangular cross section have a length of about 0.006 to about 0.20 inches, a base of about 0.002 to about 0.05 inches, and a height of about 0.002 to about 0.05 inches. Preferably, the metal particles have a length of about 0.01 to about 0.18 inches, a base of about 0.003 to about 0.04 inches and a height of about 0.003 to about 0.04 inches. To achieve the full advantage of the present invention, the metal particles have a length of about 0.015 to about 0.16 inches, a base of about 0.004 to about 0.035 inches and a height of about 0.004 to about 0.035 inches.

The metal particles also have an aspect ratio (i.e., length to base ratio) at least 3 to 1, and preferably at least 5 to 1. To achieve the full advantage of the present invention, the metal particles have an aspect ratio of about 5 to 1 to about 20 to 1.

Figure 2:
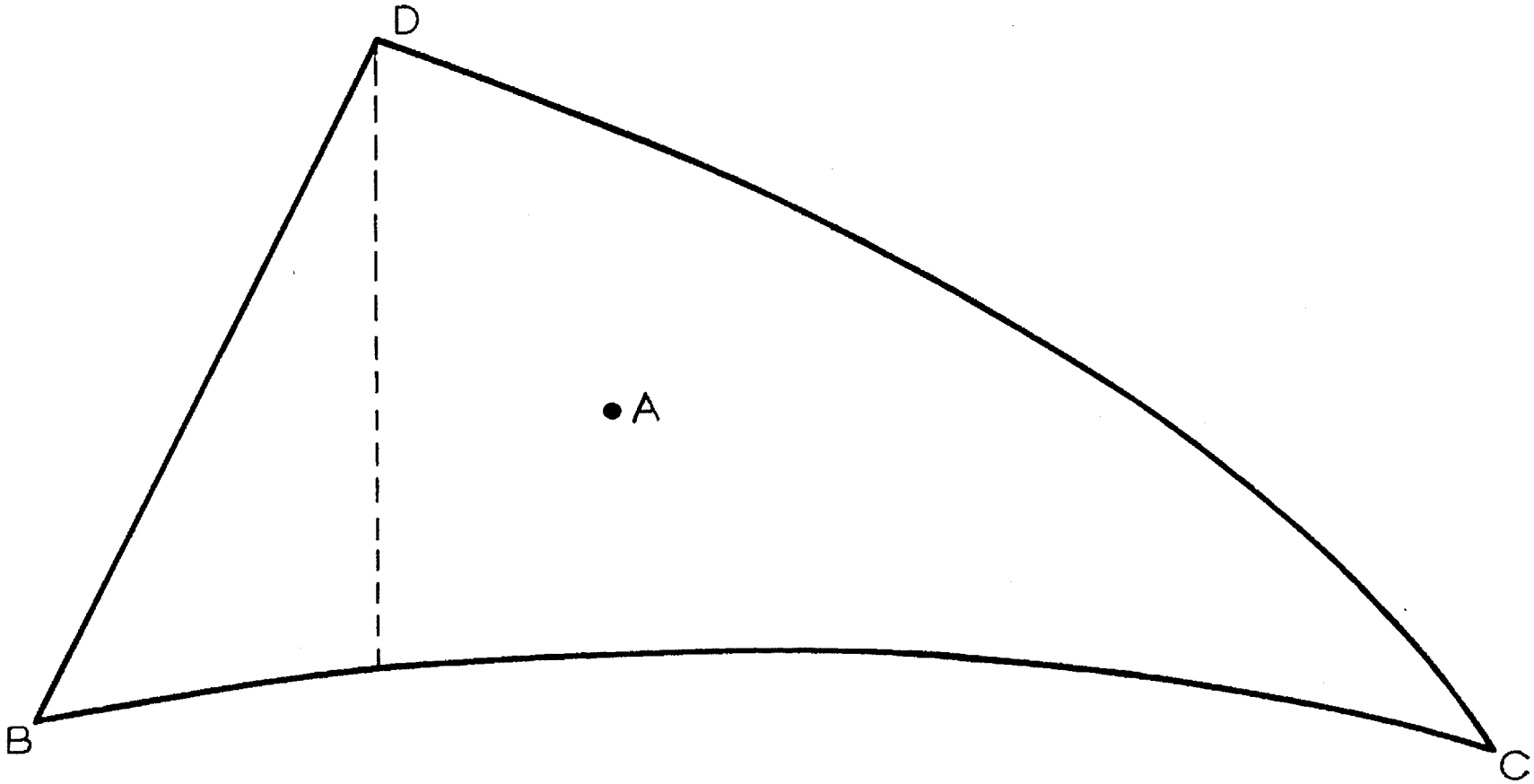
FIG. 2 is a cross sectional view of one embodiment of a metal particle used in the present powder metallurgy method.

The metal particles are not spiralled, but are substantially linear, elongated particles having a substantially triangular cross section, as illustrated in an embodiment depicted in FIG. 2. In particular, with reference to FIG. 2, when viewed from a point A in the center of the particle, the metal particle has a first longitudinal surface that is concave, a second longitudinal surface that is convex, and a third longitudinal surface that is planar or concave. Preferably, the third longitudinal surface is planar. With further respect to FIG. 2, segment B-C illustrates the base, and segment D-E illustrates the height, of the substantially triangular cross section.

It should be understood that metal particles having a substantially triangular cross section are useful in the present invention are not limited to the embodiment depicted in FIG. 2. The metal particles can have longitudinal surfaces that are independently convex, concave, or planar.

The substantially linear, nonspiralled metal particle depicted in FIG. 1 has a shape that permits improved deformation and interlocking between metal particles in the die. An increase in deformation and interlocking between metal particles increases the green strength of the green compact and the final density of the metal component. In comparison, spherical particles have a poor ability to deform and interlock, and green compacts and metal components prepared from spherical particles have a relatively low density.

To further increase interlocking between metal particles and to more effectively fill the die cavity, the metal particles of substantially triangular cross section have a height-to-base ratio of about 0.08:1 to about 1:1. In addition, a major proportion of the metal particles have a triangular cross section wherein the height-to-base ratio is about 0.2:1 to about 1:1, and preferably about 0.3:1 to about 1:1. To achieve the full advantage of the present invention, the metal particles of substantially triangular cross section have a height-to-base ratio of about 0.5:1 to about 1:1.

The acicular metal particles can be formed in any number of ways and the particular method of manufacturing the metal particles is dictated solely by the overall economics of the process. The process steps, and apparatus used in the method, are well known to persons skilled in the art.

In particular, acicular metal particles having the size, dimensions, and geometry suitable for use in the method of the present invention are manufactured by a machining, or milling process, wherein a block or sheet of the metal is fed through a carbide mill or a high-speed steel end mill. The mill has serrated flutes, or inserts, which determine the length of the acicular metal particles. The other dimensional and geometrical properties of the metal particles are determined by the mill speed, metal feed rate, and depth of cut.

The metal particle mixture is prepared by simply admixing the metal particles with the lubricant and any optional ingredients, like carbon, until the mixture is homogeneous. The metal particle mixture then is introduced into a die of predetermined size and shape.

Surprisingly, the substantially linear, acicular metal particles utilized in the present invention have a die fill ratio of less than 3 to 1. In particular, the acicular metal particles have a die fill ratio as low as about 2.5 to 1, and typically about 2.7 to 1. A low die fill ratio permits the use of a shorter die because the metal particles fill the die more efficiently. The use of a shorter die results in economies with respect to the cost of the die, and in an increased die life because of reduced die abrasion during the pressing operation.

The die fill ratio of the substantially linear, acicular metal particles approaches the die fill ratio of spherical metal powders (i.e., about 2.3 to 1). However, the acicular metal particles overcome the previously described disadvantages associated with spherical powders. The present metal particles having a substantially triangular cross section have a substantially improved die fill ratio compared to acicular metal particles having a rectangular cross section, which typically have a die fill ratio of about 3.5 to 1.

In addition, as demonstrated hereafter, it is not necessary to design a die that is appreciably larger than the green compact because the green compact does not appreciably reduce in volume during the heating and sintering steps. The green compact is sufficiently densified during the pressing step such that the green compact exhibits a shrinkage of 2% or less in volume, i.e., exhibits essentially no shrinkage, during the heating and sintering steps. Manufacture of a metal component therefore is facilitated because shrinkage of the green compact normally encountered during heating and sintering, such as about 5% to about 50% in volume, does not have to be considered in designing the size and shape of the die. The die can be of essentially the same size and shape of the finished metal component.

The metal particle mixture in the die then is subjected to a cold uniaxial pressing operation to form a green compact. The metal particle mixture is pressed at about 60,000 to about 130,000 pounds per square inch (psi), and preferably at about 80,000 to about 120,000 psi. Due to the size and geometry of the metal particles, a single, cold uniaxial pressing operation provides a green compact having a density at least 95%, and typically at least 96%, of the theoretical density of the metal.

Because the metal particle mixture provides a green compact having a density at least 95% of theoretical density, a second pressing step is not required. A second pressing step can be performed, but the density of the green compact is not increased appreciably. Therefore, the second pressing step is essentially wasted. In addition, because of the high green density of the green compact, hot uniaxial pressing and isostatic pressing operations can be avoided.

The green compacts exhibit excellent green strength after a single, cold uniaxial pressing. The green strength of the green compact is sufficient to permit handling of the green compact without damaging or destroying the green compact during removal from the die.

The green compact is heated to form the metal component, and the metal component then can be sintered. The heating operation pyrolyzes the lubricant, and the sintering operation strengthens the metal component. In accordance with an important feature of the present invention, conversion of the green compact to a metal component during the heating and optional sintering operations results in about 2% or less shrinkage of the green compact, by volume. The heating and sintering operations, therefore, serve to pyrolyze the lubricant, to bond the metal particles, and to impart strength to the metal component, but do not appreciably increase the density of the green compact. Typically, the heating and sintering operations provide a metal component having a density that is about 0.1% to about 2% greater than the density of the green compact.

The heating and sintering process conventionally is a two- to three-hour heating cycle, wherein the green compact is first heated to about 300° C. to about 400° C. to slowly and cleanly pyrolyze the lubricant into gaseous compounds. The heating step provides a metal component having sufficient strength for use in many practical applications. However, for a majority of applications, the metal component requires additional strength. Metal components used in these applications are sintered after the heating step, at about 1000° C. to about 1400° C., and preferably about 1100° C. to about 1300° C. for about 30 to about 60 minutes to bond the metal particles, strengthen the metal component, and form a sintered metal component.

After the heating or sintering operation, the metal component is allowed to cool. After optional secondary operations, like polishing and deburring, the metal component can be used for in its intended application.

The optional secondary operations can include additional pressing or sintering operations, but repressing and resintering operations are not required. The secondary operations are well known in the art of metallurgy, and are performed after the metal component has been manufactured. The green compact and the metal component each have a sufficient density and strength after a single, cold uniaxial pressing step and a single heating and sintering operation such that time-consuming and expensive repressing and resintering operations can be eliminated.

Metal components prepared by the above-described process can be used in automotive and marine applications, for example, as gears; in ordnance, as timing mechanism; in hardware, as fasteners; in electrical devices; as switch gear components; and in household goods. The metal components also can be used in other applications that typically use components manufactured by powder metallurgy.

To illustrate the manufacture of a green compact and a metal component by powder metallurgy using substantially linear, elongated metal particles of substantially triangular cross section, the following green compacts and metal components were prepared.

First, a green compact was prepared using linear, elongated metal particles of substantially triangular cross section, as described above. The metal particles were iron particles. The iron particles had a volume such that the surface area-to-weight ratio was less than one-fifth of the surface area-to-weight ratio of a spherical powder typically used in powder metallurgy, i.e., about 400 square centimeters per gram ($cm^2/g$).

In particular, the iron particles of substantially triangular cross section had an aspect ratio of about 3:1 to about 4:1, and a surface area of about 10 $cm^2/g$. The amount of lubricant required was about 0.05% to about 0.1% by weight of the iron particles and lubricant. The iron particles and lubricant were cold, uniaxially pressed at 125,000 psi to provide a green compact having a density greater than 96% of theoretical density.

In another test, iron particles having an aspect ratio of about 7:1 to about 14:1 and a surface area of about 10 $cm^2/g$ were admixed with a lubricant (i.e., about 0.05% to about 0.1% by weight of the iron particles and lubricant). The resulting iron/lubricant mixture was cold, uniaxially pressed at 125,000 psi to provide a green compact having a density greater than 97% of theoretical density and having good green strength.

In another test, substantially linear, acicular iron particles having a substantially triangular cross section, an aspect ratio of about 5:1, a die fill ratio of about 2.7:1, and a surface area of about 10 $cm^2/g$ were admixed with various amounts of a lubricant. The resulting iron particle mixtures were cold, uniaxially pressed at various pressures to provide green compacts having a complicated shape. The amount of lubricant in the iron particle mixtures was 0.2, 0.1 or 0.05 weight percent of the mixture. The iron particle mixtures were pressed at pressing pressures of 80, 100, and 120 kpsi. Each green compact exhibited a density of at least 96% theoretical density, as illustrated in Table 1.

TABLE 1

| Lubricant | Percent of Theoretical Density | | |
|---|---|---|---|
| Level[1] | 80 kpsi[2] | 100 kpsi | 120 kpsi |
| 0.2% | 96.6%[3] | 96.6% | 96.9% |
| 0.1% | 95.9% | 97.4%[3] | 97.4% |
| 0.05% | 96.2% | 97.1% | 97.6% |

[1]magnesium stearate;
[2]Target loads: kpsi = 10000 × psi; and
[3]Iron particle mixture pressed with a load about 10% highter than the target load.

The green compacts were heated at about 300° C. to about 400° C. for about one hour to pyrolyze the lubricant. The resulting metal components had a volume that was essentially the same as the volume of the green compact. The metal components had sufficient density and strength for use in some practical applications without the need of a sintering step.

Obviously, many modifications and variations of the invention as hereinbefore set forth can be made without departing from the spirit and scope thereof, and therefore, only such limitations should be imposed as are indicated by the appended claims.

We claim:

1. A method of manufacturing a metal component comprising:

(a) forming a metal particle mixture, said metal particle mixture comprising:

(i) metal particles, and (ii) about 0.015% to about 0.5% by weight of a lubricant, wherein the metal particles are substantially linear, nonspiralled, acicular particles having a substantially triangular cross section;

(b) subjecting the metal particle mixture to a cold uniaxial pressing operation to form a green compact having a density at least 95% of the theoretical density of the metal component; and (c) subjecting the green compact to a heating operation for a sufficient time and at a sufficient temperature to pyrolyze the lubricant and to form the metal component.

2. The method of claim 1 further comprising:

(d) subjecting the metal component to a sintering operation for a sufficient time and at a sufficient temperature to bond the metal particles and form a sintered metal component.

3. The method of claim 1 wherein the metal particles have a substantially triangular cross section and a height-to-base ratio of about 0.08:1 to about 1:1.

4. The method of claim 1 wherein a major proportion of the metal particles have a height-to-base ratio of about 0.2:1 to about 1:1.

5. The method of claim 1 wherein a major proportion of the metal particles have a height-to-base ratio of about 0.3:1 to about 1:1.

6. The method of claim 1 wherein a major proportion of the metal particles have a height-to-base ratio of about 0.5:1 to about 1:1.

7. The method of claim 1 wherein the metal particles have a length-to-base ratio of at least 3 to 1.

8. The method of claim 1 wherein the metal particles have a length-to-base ratio of at least 5 to 1.

9. The method of claim 1 wherein the metal particles have a length-to-base ratio of about 5:1 to about 20:1.

10. The method of claim 1 wherein the metal particles have a length of about 0.006 to about 0.20 inches, a base of about 0.002 to about 0.05 inches, and a height of about 0.002 to about 0.05 inches.

11. The method of claim 1 wherein the metal particles, when viewed from a point in the center of the particle, have a first longitudinal surface that is concave, a second longitudinal surface that is convex, and a third longitudinal surface that is planar or concave.

12. The method of claim 11 wherein the third longitudinal surface is planar.

13. The method of claim 1 wherein the metal particle mixture comprises at least 99.5% by weight metal particles.

14. The method of claim 1 wherein the metal particles comprise a metal selected from the group consisting of iron, aluminum, stainless steel, copper, a super alloy, titanium, zinc, nickel, tin, beryllium, niobium, chromium, molybdenum, tungsten, cobalt, and mixtures thereof.

15. The method of claim 1 wherein the metal particles comprise iron.

16. The method of claim 15 wherein the metal particle mixture further comprises up to about 12% by weight of a powder, said powder selected from the group consisting of carbon, manganese, nickel, copper, molybdenum, and mixtures thereof.

17. The method of claim 15 wherein the metal particles contain up to about 12% by weight carbon, manganese, nickel, copper, molybdenum, and mixtures thereof.

18. The method of claim 15 wherein the iron is alloyed with molybdenum, manganese, chromium, carbon, sulfur, silicon, copper, nickel, vanadium, niobium, gold, aluminum, phosphorus, or mixtures thereof.

19. The method of claim 1 wherein the metal particle mixture comprises about 0.015% to about 0.25% by weight of the lubricant.

20. The method of claim 1 wherein the metal particle mixture has a die fill ratio of less than about 3 to 1.

21. The method of claim 1 wherein the metal particle mixture has a die fill ratio of about 2.5 to 1 to about 3 to 1.

22. The method of claim 1 wherein the metal particle mixture has a die fill ratio of about 2.7 to 1 to about 3 to 1.

23. The method of claim 1 wherein the density of the green compact is at least 96% of the theoretical density of the metal component.

24. The method of claim 1 wherein the heating operation reduces the volume of the green compact by about 2% or less.

25. The method of claim 2 wherein the sintering operation reduces the volume of the metal component by about 2% or less.

26. The method of claim 2 wherein the sintered metal component has a density that is about 0.1% to about 2% greater than the density of the green compact.

27. A metal component manufactured by the method of claim 1.

28. A metal component manufactured by the method of claim 2.

29. A metal component prepared by a powder metallurgy process from substantially linear, nonspiralled, acicular metal particles having a substantially triangular cross section.

30. The metal component of claim 29 having a density of at least 95% of theoretical density.

* * * * *